United States Patent [19]

Yamato et al.

[11] 4,333,990

[45] Jun. 8, 1982

[54] HEAT-SENSITIVE RECORDING PAPER

[75] Inventors: Noboru Yamato; Tosimi Satake, both of Tokyo, Japan

[73] Assignee: Jujo Patper Co., Ltd., Tokyo, Japan

[21] Appl. No.: 221,793

[22] Filed: Dec. 31, 1980

Related U.S. Application Data

[63] Continuation of Ser. No. 68,444, Aug. 21, 1979, abandoned.

[30] Foreign Application Priority Data

Aug. 25, 1978 [JP] Japan ..... 53-104163

[51] Int. Cl.[3] ..... B41M 5/18

[52] U.S. Cl. ..... 428/531; 106/21; 162/162; 282/27.5; 427/150; 427/151; 427/152; 428/328; 428/488; 428/537; 428/913; 524/437; 524/594

[58] Field of Search ..... 106/21, 308 N; 162/162; 282/27.5; 427/150-152; 428/328, 329, 488, 506, 511, 530, 537, 702, 913, 914; 260/37 R, 37 NP, 37 P, 38

[56] References Cited

U.S. PATENT DOCUMENTS 4,168,845 9/1979 Oeda et al. ..... 282/27.5

*Primary Examiner*—Bruce H. Hess

*Attorney, Agent, or Firm*—Stevens, Davis, Miller & Mosher

[57] ABSTRACT

A heat-sensitive recording paper containing in its color-developing layer aluminum hydroxide as fillers and a colorless or pale-colored chromogenic dyestuff and a phenolic substance as chromogenic elements. This heat-sensitive recording paper incorporates high image density and very preferable recording aptitude with less abrasiveness and less residues accumulated even for long time recording.

5 Claims, No Drawings

HEAT-SENSITIVE RECORDING PAPER

This is a continuation of application Ser. No. 68,444 filed Aug. 21, 1979, now abandoned.

BACKGROUND OF THE INVENTION

The present invention relates to a heat-sensitive recording paper, and more particularly, to such a heat-sensitive recording paper having very preferable recording aptitude which can be obtained by adding aluminum hydroxide into the color-developing layer of the heat-sensitive recording paper containing a coloreless or pale-colored chromogenic dyestuff and a phenolic substance as chromogenic elements.

A heat-sensitive recording paper that utilizes a heat color-developing reaction occurring between a coloreless chromogenic dyestuff having a structure such as a lactone, lactam, spiropyrane or the like and phenolic substance is disclosed, for example, in the Japanese Patent Publication Nos. 4160/68 and 14039/70, and the Japanese Laid-Open Patent Application No. 27736/73, and are now widely put into practical use.

Such a heat-sensitive recording paper is produced by applying on the paper surface the coating prepared by individually grinding and dispersing a coloreless chromogenic dyestuff and phenolic substance into fine particles, mixing the resultant particles with each other and then adding thereto a binder, filler, sensitizer, slipping agent and other auxiliaries. When subjected to heat, the coating undergoes a chemical reaction which instantaneously developes a color, and various colores can be advantageously developed in bright color depending upon selection of specific colorless chromogenic dyestuff.

These heat-sensitive recording papers have now been finding a wide range of applications, including medical or industrial measurement recording instruments, terminals of computer and information communication systems, printers of electronic calculators, facsimile equipment, automatic ticket vending machines, and so on.

These recording equipment has a heating element such as a thermal head or heating pen (stylus) and the heat-sensitive recording paper, when urged with such a heating element under predetermined pressure, is heated thereby to develop a color for recording.

Thermal heads that have been produced so far are diverse in their materials used and configuration. Accordingly, since the requirements for heat-sensitive recording paper vary largely with the performance (thermal response, thermal isolation among heaters, heat dissipation, heat resistance, wear resistance, power consumption, production cost), controlling method, recording conditions (impressed voltage, energizing time, surface temperature, contacting pressure, head scanning method, recording speed and contents of information to be recorded) or the like of the specific thermal heads used, the matching performances between the respective heat-sensitive recording papers and the recording equipments is very important. Especially in recent years, as the applications of recording equipment tend to be diversified and call for a higher performance, a higher quality has come to be required for heat-sensitive recording papers to be used thereon.

A thermal head is ordinarily subjected to its heating and cooling cycles repeatedly at a short cyclic period of 0.5–20 milliseconds, and the color-developing layer of a heat-sensitive recording paper contacted with the thermal head receives heat energy generated by the latter to cause a color-developing reaction for recording purpose. In this instance, in one type of a recorder, the thermal head itself laterally reciprocatingly moves to apply impressed pulses to a heating element at a timing required for a print image to thereby print images while feeding the recording paper, and in another type, the thermal head is stationary, and the heat-sensitive recording paper is fed at a timing of the impressed pulses.

In a heat-sensitive recorder such as an electrocardiograph, the heated stylus (heating pen) is contacted with the heat-sensitive recording paper under predetermined pressure, and is fluctuated while feeding the recording paper for recording.

The thermal head and the heating pen record while urging in contact with the heat-sensitive recording paper under predetermined pressure. Since the amount of heat conducted to the heat-sensitive recording paper depends greatly upon the close contact between the head or the pen and the recording paper, the heat-sensitive recording paper is desired to incorporate high smoothness on the surface thereof, and must have a sufficient color-developing sensitivity for producing bright chromogenic records with such a small heat input from the thermal head.

Inasmuch as the thermal head and the heating pen always make pressure contact and friction with the heat-sensitive recording paper, they are required to accommodate hard surface, wear resistance, and the heat-sensitive recording paper have to be less abrasive simultaneously.

The thermal head is constructed to normally have a wear resistant layer or resistor protective layer of hard material such as $SiO_2$, $Ta_2O_5$, $Al_2O_3$, SiC, glass, etc. on a heating resistor such as $Ta_2N$, Ta-Si, Ta-Al, $S_nO_2$, Ni-Cr, silicone, $RnO_2$, Pt-Ag, etc. However, the low cost thick film type thermal head incorporates no wear resistant layer sometimes. The heat-sensitive recording paper is strongly desired to be less abrasive for the thermal head when used for the recorder having such a thermal head.

Since the head pressure and sliding speed tend to be increased as the recent recording speed is accelerated and the packing image density is increased, the necessity for the low abrasiveness of heat-sensitive recording paper is further enhanced.

As the thermal head is, in addition, heated and cooled repeatedly in the recording process, heat-sensitive materials contained in the color-developing layer of the heat-sensitive recording paper is once melted and then solidified. In this course, a portion of the heat-sensitive materials may stick to the head surface and, consequently, the melted heat-sensitive materials may be accumulated on the head surface as "residues." If this occurs, such accumulated residues will obstruct the conduction of heat from the head to heat-sensitive recording paper to render printed images obscure and, sometimes, to such an extent that the records are hardly readable.

If the heat-sensitive paper also adhers or sticks to the thermal head causing a so-called "sticking," the movement of the paper or head will be obstructed with generation of offensive sounds and, in the worst case, the recording function itself may become impossible.

Further, as the heat-sensitive materials deposited on the thermal head may be retransferred to the surface of heat-sensitive paper, the thermal head may not be cooled sufficiently in the cooling cycle succeeding to the printing cycle due to the accumulation of the heat-sensitive material or an increase in the ambient temperature of the head may heat any portions of the heat-sensitive paper other than those required for intended printed images to cause undesired coloring thereat, the print image may be degraded with such phenomena as bleeding, smearing or ghost resulting therefrom.

Various addition materials are generally added to the coating to be applied on the color-developing layer of the heat-sensitive papers in addition to a chromogenic dyestuff, phenolic substance and binders constituting its basic ingredients. For example, with a view to improving the color-developing sensitivity, preventing adhesion of the heat-sensitive materials onto the head and preventing a frictional smudge, such waxes as paraffin waxes, polyolefin waxes, fatty amides and their methylol derivatives, higher fatty acids and their metal salts, condensates of a higher fatty acid and amine, polyhydric alcohol esters of higher fatty acids, higher alcohols and so on are added to heat-sensitive coating formulations.

Also, for improving the coating aptitude, whiteness and brightness, preventing adhesion of residues onto the thermal head, or preventing sticking of the heat-sensitive recording paper to the head, clays such as china clay, kaolin, talc, calcined clay, titanium oxide, calcium carbonate, magnesium carbonate, zinc oxide, etc. as fillers are used.

To obtain the heat-sensitive recording paper having superior recording aptitude to meet the requirements for high performance and recording speed of recent heat-sensitive recording equipments, the aforementioned various addition materials must be suitably mixed. However, the kaolin and other fillers heretofore used exhibit a problem in the abrasiveness for the thermal head and the heating pen.

SUMMARY OF THE INVENTION

Accordingly, an object of the present invention is to provide a heat-sensitive recording paper which can obtain high image density and bright print image records.

It is another object of the present invention to provide a heat-sensitive recording paper which causes less residues to accumulate on the thermal head surface and less sticking of the paper to the head even for long time recording.

It is still another object of the invention to provide a heat-sensitive recording paper which incorporates less abrasive recording surface sufficiently durable for the enhanced pressure and accelerated sliding speed of the thermal head as the recording speed is accelerated and the packing image density is increased.

The above and other related objects can be performed by incorporating 20–65 weight % of aluminum hydroxide with respect to the total weight of the color developing layer in the heat-sensitive recording paper of the present invention.

DETAILED DESCRIPTION OF THE PREFERRED EMBODIMENTS

Aluminum hydroxide is a pigment having a thin hexagonal layer crystal of monoclinic system represented by a chemical formula of $Al(OH)_3$ or $Al_2O_3.3H_2O$, which is sold with a trade name of "HYDRAL" from ALCOR CO., LTD. in the U.S.A. and also with a trade name of "Hygillite" from Showa Denko K.K. in Japan.

The aluminum hydroxide is partly used as auxiliary filler for the coating of a coated paper or general paper in a papermaking field, but is not found for use in the filler of a heat-sensitive recording paper.

The physical and optical properties of the aluminum hydroxide are shown in comparison with other representative filler in the following Table:

| | Aluminum hydroxide | Kaolin clay | Calcium carbonate | Titanium carbonate |
|---|---|---|---|---|
| Whiteness | 98–100% | 75–91% | 100% | 90% |
| Refractive index | 1.57 | 1.57 | 1.66 | 2.55 |
| Valley abrasive factor | 6–8mg | 4–10mg | 0.6mg | 20mg |
| Mohs hardness | 2.5–3.5 | 1.5–2 | 3–4 | 5.5–6 |

(Note):
These date are from Tappi Monograph Series No. 38 "Paper Coating Pigments" (1976) and Hydral Technical Information (1962) in ALCOA Co., Ltd.

It is known that the aluminum hydroxide has high whiteness and relatively less abrasiveness of a pigment as shown in the above Table. However, it was successfully found that, when the aluminum hydroxide is incorporated as a filler to a heat-sensitive recording paper. Remarkably more advantageous practical effects can be obtained than predicted from the numeral values shown in the above Table. The best results were achieved by adding 20–65 weight % of aluminum hydroxide with respect to the total weight of the color developing layer as disclosed in the examples. The remarkably advantageous practical effects in the present invention are as follows:

(1) High whiteness and smoothness can be easily obtained
(2) High image density and print image quality can be easily obtained
(3) Very low abrasiveness
(4) Less accumulated residues and sticking
(5) Amount of coating color on paper can be decreased, and production efficiency can also be improved.

The definite reasons for obtaining these superior advantages are not yet sufficiently clarified. However, it is considered that the relative hardness between the aluminum hydroxide and the thermal head materials, crystalline form, material dispersed state in the coating color, and affinity to the color-developing material and addition materials, etc. are concerned complicatedly.

This aluminum hydroxide may be used as a filler singly or in combination, or kaolin, calcium carbonate, magnesium carbonate, aluminum silicate may be mixed therewith in a suitable amount in accordance with the specific application and intended performance.

However, it is necessary to add at least 50% by weight of aluminum hydroxide per total filler.

Normally colorless or pale-colored chromogenic dyestuffs usable according to the present invention cont ain: crystal violet lactone (blue), 3-diethylamino-6-methyl-7-chlorofluorane (vermilion), 3-cyclohexylamino-6-chlorofluorofluorane (yellowish orange), 6-diethylamino-7-dibenzilaminofluorane (green), 3-diethylamino-6-methyl-7-anilinofluorane (black), and 3-pyrrolidino-6-methyl-7-anilinofluorane (black), etc.

Phenolic substances usable according to the present invention contain: bisphenol A (4,4'-isopropylidene diphenol), p-p' (1-methyl-n-hexylidene) diphenol, p-tert-butyl phenol, p-phenylphenol, and phenolic novolac resins, etc. These chromogenic dyestuffs, phenolic substances and other additives are dispersed in water or solvent. Thus, a suitable binder is required to apply the coating onto the surface of a substrate such as of paper or film. As the binder, the following substances may be used: polyvinyl alcohol, methyl cellulose, hydroxyethyl cellulose, gum arabic, carboxymethylcellulose, starch, gelatin, casein, polyvinyl pyrrolidone, styrene-maleic anhydride copolymers, polyacrylates, and polyacrylic copolymers, etc.

According to the present invention, the aforementioned chromogenic dyestuffs, phenolic substances, inorganic fillers and waxes are dispersed or dissolved in an aqueous solution containing a water-soluble binder. In this case, it is preferred that these dispersed particles are ground as minutely as possible and, more specifically, down to a particle size of several microns or smaller by means of a ball mill, attritor or sand grinder. Waxes and fatty amide type waxes may be used in dispersion as mentioned above or may be added as an emulsion. As auxiliaries, activators such as dispersing agents or antifoamers may also be added.

The amount of aluminum hydroxide and other ingredients to be incorporated in accordance with the present invention are determined as stated before depending upon the performance and recording aptitude required for the specific heat-sensitive recording paper product that is used on the particular heat-sensitive recording equipment having specific characteristics. However, in ordinary cases, 3–10 parts of bisphenol A and 5–25 parts of aluminum hydroxide are used per 1 part of a chromogenic dyestuff. While, it is suitable to add 10 to 20 parts of a binder per 100 parts of total solid content. "Parts" are expressed as "Parts by weight" in the present invention.

Hereinafter, the present invention will be described further by way of typical examplary formulations of the preferred embodiments thereof.

EXAMPLE 1

| | |
|---|---|
| Solution A | |
| 3-diethylamino-6-methyl-7-anilinofluorane | 2.0 parts |
| 10% aqueous solution of polyvinyl alcohol | 4.6 parts |
| water | 2.5 parts |
| Solution B | |
| 4,4-isopropylidene diphenol | 6.0 parts |
| Amide HT (LION AKZO COMPANY, LTD.) | 3.0 parts |
| Zinc stearate | 0.5 part |
| 10% aqueous solution of polyvinyl alcohol | 19.0 parts |
| water | 19.0 parts |

The solutions A and B were individually ground into a dispersed state by an attritor for three hours. Then, both the solutions A and B were mixed. 20 parts of aluminum hydroxide (a trade name of "Hygillite H-42" manufactured by Showa Denko K.K. in Japan) and 10 parts of 10% aquesou solution of polyvinyl alcohol were added into the mixture of the solutions A and B, respectively to prepare heat-sensitive coating color. The range of aluminum hydroxide addition with respect to the total weight of the color developing layer was approximately 57% by weight from the calculation of the above respective contents.

20 parts of kaolin clay or calcium carbonate was incorporated instead of the aluminum hydroxide to similarly prepare heat-sensitive coating color as a reference example. Thereafter, the resultant coating colors were applied by an air knife coater on base papers weighing 50 g/m$^2$ at a coating weight of 6 g/m$^2$, respectively, and were then dried and calendered, to thereby prepare a black-color-developing heat-sensitive recording papers. The resultant heat-sensitive recording papers were tested for their quality and performance, and the test results were shown in Table 1 as below.

TABLE 1

| | Example | Reference example | Reference example |
|---|---|---|---|
| Fillers | Aluminum hydroxide (Hygillite H-42) | Kaolin clay (Ultrawhite 90) | Calxium carbonate (Precipitated) |
| Whiteness | 81.2% | 79.2% | 74.0% |
| Smoothness | 344 sec. | 269 sec. | 192 sec. |
| Static color-developing density (1) | 1.41 | 1.35 | 1.36 |
| High speed printer print image quality (2) | good | common | improper |
| Heating pen wearing amount (3) | 2μ | 14μ | 14.5μ |

Notes:
(1) The heat-sensitive recording papers were pressed down for 5 seconds under 10g/cm$^2$ against at hot plate heated at 150° C. and the developed color density was measured by using a Macbeth densitometer RD-514 (with an amber filter).
(2) Print images were continuously recorded by using a high speed printer (120 characters/sec.) having a thin film thermal head.
(3) Sine waves of 50kHz in frequency and 30mm in amplitude were continuously recorded on a paper of 100m long (approx. 6,000m of pen running distance) by using an electrocardiograph FD101 manufactured by "FUKUDA DENSHI CO., LTD." with paper feeding speed of 25m/sec. and pen pressure of 7g. Then, the heating pen was measured in its wear amount by using a needle contact type surface analizer SE-4 manufactured by "KOSAKA LABARATORY LTD.".

As obviously seen from Table 1, the heat-sensitive recording papers using aluminum hydroxide according to the present invention can provide high whiteness, smoothness, and image density, superior recording aptitude for a high speed printer, and very low wear (abrasiveness) for the heating pen as compared with the reference example using kaolin clay and calcium carbonate.

EXAMPLE 2

| | |
|---|---|
| Solution A | |
| Crystal violet lactone | 1.5 parts |
| 10% aqueous solution of polyvinyl alcohol | 3.4 parts |
| Water | 1.92 parts |
| Solution B | |
| The same as the solution Example 1. | |

The solution A and B were individually ground for one hour by means of a testing sand grinder into a dispersion, respectively. Then, both the solutions A and B were mixed. 6 parts of aluminum hydroxide and 4 parts of kaolin clay were added into the mixture of the solutions A and B to prepare heat-sensitive coating color. 10 parts of kaolin clay was mixed instead of the aluminum hydroxide and the kaolin clay to similarly prepare heat-sensitive coating color as a reference example. The range of aluminum hydroxide addition with respect to the total weight of the color developing layer was approximately 20% by weight from the calculation of the above respective contents. The resultant coating colors were applied by using an air knife coater on base papers weighing 50 g/m$^2$ at a coating weight of 6 g/m$^2$, respectively, and were then dried and calendered, to thereby prepare a blue-color-developing heat-sensitive recording papers. The resultant heat-sensitive recording papers were tested for their quality and performance, and the test results were shown in Table 2 as below.

TABLE 2

| | Example | Reference example |
|---|---|---|
| Fillers | Aluminum hydroxide (6) + kaolin clay (4) | Kaolin clay (10) (alpha plate) |
| Whiteness | 82.4% | 81.4% |
| Smoothness | 322 sec. | 281 sec. |
| Static color-developing density | 1.40 | 1.35 |
| Small printer print image quality (1) | excellent | good |
| Thermal head wearing amount (2) | 2μ | 16μ |

Notes:
(1) "Divisumma 33" electronic calculator (using thick film type thermal head incorporating no wear resistant layer) manufactured by "Olivetti co.".
(2) 4,2000,000 characters were continuously printed using the above "Divisumma 33" electronic calculator. The heights of the respective dots of the therma head were measured before and after the test to calculate the wear amount from the difference therebetween.

As obviously seen from Table 2, the heat-sensitive recording papers of the present invention can provide high whiteness, smoothness, and image density, excellent print image without swearing nor bleeding, and very low wear (abrasiveness) for the thermal head having no wear resistant layer.

EXAMPLE 3

| | |
|---|---|
| Solution A | |
| Crystal violet lactone | 0.93 part |
| 10% aqueous solution of polyvinyl alcohol | 4.06 parts |
| Water | 1.74 parts |
| Solution B | |
| 4,4' isopropylidene diphenol | 6.00 parts |
| Ethylene-bis-stearoamide* | 0.31 part |
| 10% aqueous solution of polyvinyl alcohol | 41.30 parts |
| Zinc stearate | 0.31 part |
| Water | 5.83 parts |

*Manufactured by Lion Akzo Company. Ltd with a trade name of "Armo Wax".

The solutions A and B were individually ground into a dispersion for three hours by means of an attritor. Then, both the solutions A and B were mixed. 20 parts of aluminum hydroxide was added into the mixture of the solution A and B to prepare heat-sensitive coating color. 20 parts of kaolin clay was mixed instead of the aluminum hydroxide to similarly prepare heat-sensitive coating color as a reference example. The range of aluminum hydroxide addition with respect to the total weight of the color developing layer was approximately 65% by weight from the calculation of the above respective contents.

The resultant coating colors were applied by using an air knife coater on base papers weighing 50 g/m$^2$ at a coating weight of 6 g/m$^2$, respectively, and were then dried and supercalendered, to thereby prepare a blue-color-developing heat-sensitive recording papers. The resultant heat-sensitive recording papers were tested for their quality and performance, and the test results were shown in Table 3 as below.

TABLE 3

| | Example | Reference example |
|---|---|---|
| Fillers | Aluminum hydroxide ("Hygillite" H-42) | Kaolin clay (Nu-clay) |
| Whiteness | 80.5% | 79.3% |
| Smoothness | 520 sec. | 400 sec. |
| Static color-developing density | 1.42 | 1.37 |
| High speed printer print image quality (1) | excellent | common |
| Thermal head wearing amount (2) | 0.2μ | 20μ |

Notes:
(1) High speed printer P-6060 (characters/sec. of printing speed, using thick film type thermal head) manufactured by "Olivetti co.".
(2) 6,000,000 characters were continuously printed using the above high speed printer P-6060 of "Olivetti Co.". The wear amount of the respective dots were measured similarly to the Example 2.

As shown in Table 3, the heat-sensitive recording paper of the present invention can provide an easy improvement of the smoothness via a supercalender, preferable color-developing density, and print image quality, and very low wear for the thermal head. It should be understood from the foregoing description and Examples 1 through 3 that only the aluminum hydroxide addition to the color developing layer is sufficient to provide high image density, high print image quality and very low abrasiveness of the color-developing layer of a heat-sensitive paper.

What we claim is:

1. A heat-sensitive recording paper containing a colorless or pale-colored chromogenic dyestuff and a phenolic substance in the color-developing layer thereof, characterized in that said color-developing layer contains 20–65 weight % of filler of aluminum hydroxide with respect to the total weight of the color developing layer.

2. A heat-sensitive recording paper according to claim 1, wherein said color-developing layer further contains at least one substance to be selected from a group consisting of kaolin, calcium carbonate, magnesium carbonate and aluminum silicate, in addition to said aluminum hydroxide.

3. A heat-sensitive recording paper according to claim 1, wherein said chromagenic dyestuff is at least one substance to be selected from a group consisting of crystal violet-lactone, 3-diethyamino-6-methyl-7-chlorofluorane, 3-cyclohexylamino-6-chlorofluorane, 3-diethylamino-7-dibenzylaninofluorane, 3-diethylamino-6-methyl-7-anilinofluorane, and 3-pyrolidino-6-methyl-7-anilinofluorane.

4. A heat-sensitive recording paper according to claim 1, wherein said phenolic substance is at least one phenolic substance to be selected from a group consisting of bisphenol A (4,4'-isopropylidenediphenol), p-p'(1-methyl-n-hexylidene) diphenol, p-tertiary-butyl phenol, p-phenylphenol, and phenolic novolac resins.

5. A composition for a color-developing layer in a heat-sensitive recording paper, said composition consisting essentially of a colorless or pale-colored chromogenic dye stuff, a phenolic substance, and a filler of aluminum hydroxide, said aluminum hydroxide being present in an amount from 20 to 65% by weight.

* * * * *